US006538385B2

(12) United States Patent
Kanetoo et al.

(10) Patent No.: US 6,538,385 B2
(45) Date of Patent: Mar. 25, 2003

(54) CATHODE-RAY TUBE AND FLAT ELECTRODE OF ELECTRONIC GUN AND PRODUCTION METHOD

(75) Inventors: Osami Kanetoo, Chigasaki (JP); Takehisa Yoshikawa, Yokohama (JP); Keii Ueno, Yokohama (JP); Naozumi Hatada, Yokohama (JP); Satoru Endo, Shirako (JP); Takeshi Mera, Mobara (JP); Yoshiaki Takahashi, Chiba (JP); Shinichi Kato, Mobara (JP)

(73) Assignees: Hitachi, Ltd., Tokyo (JP); Hitachi Electronic Devices Co. (JP)

( * ) Notice: Subject to any disclaimer, the term of this patent is extended or adjusted under 35 U.S.C. 154(b) by 0 days.

(21) Appl. No.: 09/823,398

(22) Filed: Mar. 30, 2001

(65) Prior Publication Data

US 2002/0047528 A1 Apr. 25, 2002

(30) Foreign Application Priority Data

Jun. 22, 2000 (JP) ..... 2000-192665
Nov. 20, 2000 (JP) ..... 2000-357615

(51) Int. Cl.[7] ..... H01J 25/00; H01J 29/50

(52) U.S. Cl. ..... 315/5; 315/5.38; 315/368.16; 313/412; 313/413; 313/414

(58) Field of Search ..... 313/412, 413, 313/414, 447, 437, 382, 409, 410; 315/5, 368.16, 5.38

(56) References Cited

U.S. PATENT DOCUMENTS 5,723,938 A * 3/1998 Kato et al. ..... 313/412
5,814,930 A * 9/1998 Watanabe et al. ..... 313/414
5,847,500 A * 12/1998 Merqa et al. ..... 313/412
6,232,711 B1 * 5/2001 Sugiyama et al. ..... 313/414

FOREIGN PATENT DOCUMENTS

| | | |
|---|---|---|
| JP | 59-215640 | 12/1984 |
| JP | 3-017964 | 1/1991 |
| JP | 4-160737 | * 6/1992 |
| JP | 7-14870 | 6/1995 |
| JP | 8-336798 | 12/1996 |
| JP | 10-076324 | 3/1998 |

* cited by examiner

*Primary Examiner*—Don Wong
*Assistant Examiner*—Tuyet T. Vo
(74) *Attorney, Agent, or Firm*—Townsend and Townsend and Crew LLP

(57) ABSTRACT

A cathode-ray tube includes a plate having a first hole on a first surface of the plate and a second hole on a second surface of the plate. The first and second holes coupled together to allow electron beams to pass therethrough. The plate is a unitary structure. The first hole is formed by initiating a first hole formation from the first surface, and the second hole is formed by initiating a second hole formation from the second surface. The first surface is on an opposing side of the second surface.

15 Claims, 13 Drawing Sheets

CATHODE-RAY TUBE AND FLAT ELECTRODE OF ELECTRONIC GUN AND PRODUCTION METHOD

CROSS-REFERENCES TO RELATED APPLICATIONS

This application claims priority from Japanese Patent Application No. 00-192665, filed on Jun. 22, 2000, and Japanese Patent Application No. 00-357615, filed on Nov. 20, 2000, which are both incorporated by reference for all purposes.

BACKGROUND OF THE INVENTION

This invention relates to shapes of holes of a flat electrode of electronic gun of cathode-ray tube for use in a display device, particularly in a CRT display device, and a method for processing the flat electrode, wherein three electron beam passage holes are formed in the flat electrode of electronic gun for improving the hole diameter precision and enhancing the resolution of focus lenses.

In recent years, the enhancement of the resolution of electronic gun components of a cathode-ray tube for color television has been increasingly demanded as the progress of the minuteness and definition of the image of color display. The resolution of an electronic gun can be enhanced by deterring the occurrence of bur which induces electron discharge as viewed from the improvement of the assembly precision of the electronic gun by highly precise components and the enhancement of the withstand voltage characteristics of the electronic gun.

A cathode-ray tube (FIG. 1) for color image display consists of a panel section 1 which is an image screen, a neck section 2 for accommodating the electronic gun, and a funnel section 3 which connects panel section 1 and neck section 2, and the funnel section 3 having a deflector which makes the electron beam 5 (Bc, Bs) emitted from an electronic gun 4 scanning on a fluorescent surface 6 of the color display.

Electronic gun 4 to be installed in the neck section 2 has various electrodes, such as a cathode electrode, control electrode, focusing electrode, and accelerating electrode. Electron beam 5 which is emitted from the cathode electrode is modulated by the signal to be applied to the control electrode. Modulated electron beam 5 is given a required sectional shape and energy through the focusing and accelerating electrodes. The formed and energized modulated electron beam is made to collide with fluorescent surface screen 6. On the way that the electron beam from electronic gun 45 reaches fluorescent surface screen 6, the electron beams are deflected to both the horizontal and vertical directions by the deflector installed in funnel 3 to form an image on fluorescent surface screen 6.

On the other hand, electronic gun 4 of this kind of color cathode-ray tube has a cylindrical electrode having a nearly elliptical peripheral shape, inside which flat electrodes having electron beam passage holes are disposed. (Japanese App. No. 59-215640).

FIG. 2 is a plan view showing a block diagram of such a flat electrode, and FIG. 3 shows a sectional view of the electron beam passage hole. The flat electrode has three electron beam passage holes 8, 9, and 10.

In the prior art, in the production of a flat electrode having the electron beam passage holes 8, 9, and 10, a flat electrode including electron beam passage holes was shaped by means of through punching using a usual press machine. In this case, as an enlarged sectional view of electron beam passage hole 9 of FIG. 3 shows, a sheared surface 11 and a broken-out surface 12 are formed on the inner surface of electron beam passage hole 9, resulting in a bur 13 on the outer surface of the metal plate. In the usual punching off method, sheared section length t1 accounted for about 60% of plate thickness t, while broken-out section length t2 accounted for as much as 40% of the plate thickness t. Further, some metal plates developed burs as high as 0.01 mm on their outer surfaces.

The existence of this broken-out section 12 causes distortion mainly in the focus lens. Accordingly, in a flat electrode of which a distortion developed in the focus lens is required to be as a particularly small as possible, such a method for punching out holes in the flat electrode is applied that when punching the flat electrode from the other side surface thereof, a hole smaller than the hole to be finally punched out is punched once, and after that a shaving method is applied to enlarge the hole until it finally meets a required diameter (Japanese App. No. 3-17964).

This shaving method, as the conceptual diagram of FIG. 4 shows, is required to punch metal plate 14 a few times to achieve a hole having a diameter D so that necessary electron beam can pass through. For example, a punch 15 that can make holes with diameters of 0.5D, 0.7D, 0.9D, and 1D in a metal plate is used to enlarge the hole diameter one by one until an objective length has been reached. As a consequence, the number of times required for punching increases. The use of such a punching process, in comparison with the usual punching off method, can reduce the thickness of broken-out surface to a range of 10–20% of plate thickness t and the length of bur 13 to below 0.005 mm. In order to achieve the high resolution of an up-to-date cathode-ray tube, more precise punching is required.

Further, bur 13 causes a decline of mainly the withstand voltage characteristic of the focus lens. Although an attempt is made to remove bur 13 from the outer edge of the hole by means of barrel grinding, the end of the hole may be rounded, and an excessive rounding at the end of the hole may result in undesirable distortion of the focus lens, thereby declining the resolution of the focus lens.

The purpose of the present invention is to provide a punching method for making the broken-out section 12 shorter compared with the conventional processing method to achieve flat electrode 7 without bur 13 and a desirable flat electrode of electronic gun.

In the color cathode-ray tubes of the prior art, a shaving method was used that requires punching a few times to punch out electron beam passage holes highly precisely on a flat electrode of electronic gun so that the number of times required for punching increases, resulting in a production cost increase. In addition, because even this shaving method leaves problems that the broken-out section length of around 20% and the difficulty of removing bur completely, there was a limitation in the enhancement of the withstand voltage characteristic of electron beam.

BRIEF SUMMARY OF THE INVENTION

It is an object of the present invention to provide a method for resolving the problems, and in order to achieve the above-mentioned object, a cathode-ray tube has a metal plate having a hole, wherein electron beam passes through, and wherein the hole is different in diameter between the upper surface and lower surface of the metal plate.

Further, in order to achieve the aforementioned object, a cathode-ray tube of a metal plate having a hole, through which an electron beam from the electrode of an electronic gun passes through; wherein there exists a difference in the diameter of the hole between the upper and lower surfaces of the metal plate; and wherein the pertinent difference in diameter is within a range of ratio from 0.01 to 0.4 relative to the metal plate.

Further, in order to achieve the aforementioned objects, a cathode-ray tube of a metal plate, through which an electron beam from the electrode of an electronic gun passes; wherein there exists a difference in the diameter of the hole between the upper and lower surface of the metal plate; and wherein the pertinent difference in diameter is within a range of ratio of 0.01–0.2 relative to the metal plate.

Further, in order to achieve the aforementioned objects, a cathode-ray tube of a metal plate, through which an electron beam from the electrode of an electronic gun passes; wherein there exists a difference in the diameter of the hole between the upper and lower surfaces of the metal plate; wherein there exists a difference in the diameter of the hole, wherein there exists a difference in the hole pitch between the upper and lower surfaces of the metal plate; and wherein the ratio of the difference in the hole pitch on the upper surface thereof to that on the lower surface thereof is in a range from 0.95 to 1.05.

Further, in order to achieve the aforementioned object, cathode-ray tube has a metal plate having holes through which electron beams from the electrode of an electronic gun pass, wherein the shapes of holes on the exit sides of electron beams are elliptic, with the existence of a difference in diameter of said holes between the upper and lower surfaces of said metal plate and with the existence of a difference in hole pitch between the upper and lower surface of said plate.

Further, in order to achieve the aforementioned objects, in a flat electrode of electronic gun for the cathode-ray tube, the elliptic ratio (the ratio of the major axis to the minor axis of ellipse) of the shape of electron beam passage hole on the exit side of electron beam is within a range from 1.002 to 1.08.

Further, in order to achieve the aforementioned objects, the flat electrode of electronic gun is characterized in that, in a metal plate having holes through which electron beam passes, the holes have more than one diameters in the thickness direction of the metal plate.

Further, in order to achieve the aforementioned objects, the flat electrode of electronic gun is characterized in that, in the shape of holes through which electron beams from the electrode of electric gun pass, the diameters of the holes on one surface of the metal plate are greater than that on the other surface thereof.

Further, in order to achieve the aforementioned objects, a metal plate electrode for electronic gun is characterized in that, the difference in the diameter of a hole of the metal plate electrode, through which an electron beam from the metal plate electrode passes, between the hole diameter on one surface side of the metal plate electrode and the other surface side thereof is within a range of 1–40%.

Further, in order to achieve the aforementioned objects, a metal plate electrode for an electronic gun is characterized in that, in the shape of a hole through which an electron beam from the metal electrode for the electronic gun passes, the hole diameter is formed to flare out to form a trumpetlike shape in such a direction from the inside of the greater hole diameter to the surface of the metal plate.

Further, in order to achieve the aforementioned objects, a production method is characterized by such a production method for punching a hole in a metal plate using a punch and a die, where punching is started from the surface on one side of the metal plate and stopped in a middle section of the plate thickness, followed by punching the hole continuously until a middle section of the plate thickness from the other surface side.

Further, in order to achieve the aforementioned object, a production method for punching a metal plate is characterized by such a production method for punching the metal plate using a punch and a die where the punch for use in the punching process, which is started from one surface side and is stopped in a middle section of the plate thickness of the metal plate, has a diameter greater by 1 to 40% of the thickness of the metal plate than the diameter of the die.

Further, in order to achieve the aforementioned objects, a production method for punching a metal plate is characterized in that a punch for use in the punching process which is stopped in a middle section of the thickness of the metal plate has an elliptic sectional shape.

Another object of the present invention is to provide the processes of punching a metal plate using a punch and die with a method to stop punching in a middle section of the thickness of the metal plate on one surface side of the metal plate at the first processing stage, and a method to punch an electron beam passage hole from the other side at the second processing stage, thereby providing the electronic gun with a hole shape superior in withstand voltage characteristic. Further, in order to achieve the aforementioned objects, in the punching process stages for punching an electrode part of an electronic gun, it is desirable for the diameter of a hole punched at the first processing stage to be greater than the diameter of the hole punched at the second processing stage. Preferably, it is desirable for the diameter of the hole punched at the first processing stage to be greater by 1 to 40% of the thickness of the metal plate than the die diameter to achieve smooth finishing of the sheared inner surface of the hole.

Further, in order to achieve the aforementioned objects, in the process of punching an electrode part for an electronic gun, it is desirable to stop punching in a middle section of the first processing stage when the punching comes to a position ranging of 50–90% of the thickness of the metal plate to achieve smooth finishing of the inner surface of the hole.

Further, in order to achieve the aforementioned objects, in the process of punching an electrode part for an electronic gun, when it is required to punch a plurality of holes (e.g., three holes) in an electrode part on which the interval between adjacent holes is narrower than the hole diameter as shown in FIG. 3, it is desirable to punch the holes into an elliptic sectional shape to form the hole diameter on the punch side to be completely round.

Furthermore, in order to achieve the aforementioned objects, in the process stages of punching a plurality of holes, when punching is stopped in the middle of the first processing stage, it is desirable to half-off punch or cut the whole or part of the peripheral section of an electrode part for an electronic gun to form the hole diameter on the punch side to be substantially round.

DESCRIPTION OF THE SPECIFIC EMBODIMENTS

The following explains the cathode-ray tube and flat electrodes of an electronic gun according to embodiments of the present invention by referring to the attached drawings. In addition, a press machine is used for a series of process stages necessary for executing this invention.

Embodiment 1

Figure 5:
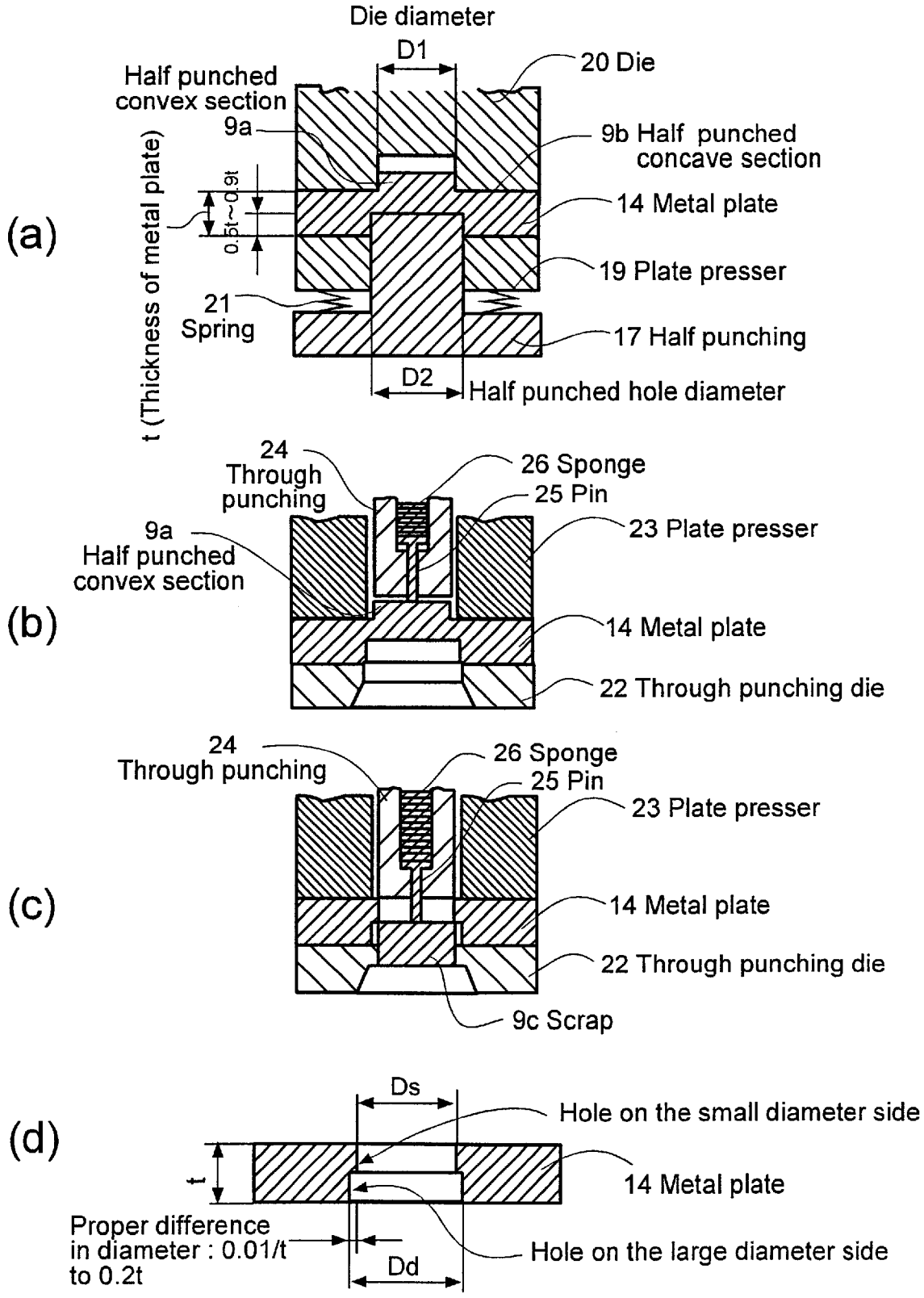
FIG. 5 is a modeled sectional view of die, etc. for explaining a punching process according to a first embodiment of the present invention.

FIGS. 5(*a*) to 5(*d*) show a schematic view of a punch processing method for embodiment 1. FIG. 5(*a*) shows a half-off punching process at the first processing stage, FIG. 5(*b*) shows a process of punching a through hole from the other side at the second processing stage, and FIG. 5(*c*) shows the state of the hole punched through at the second processing stage.

In FIGS. 5(*a*) to 5(*d*), numeral 14 stands for a metal plate, numeral 9*a* a half punched convex, numeral 9*b* a half punched concave section, numeral 9*c* scrap, numeral 17 a half-off punch, numeral 19 plate platform, numeral 20 a die, numeral 21 a spring, numeral 22 a die for through punching, numeral 25 a pin, and numeral 26 a sponge, respectively.

Figure 2:
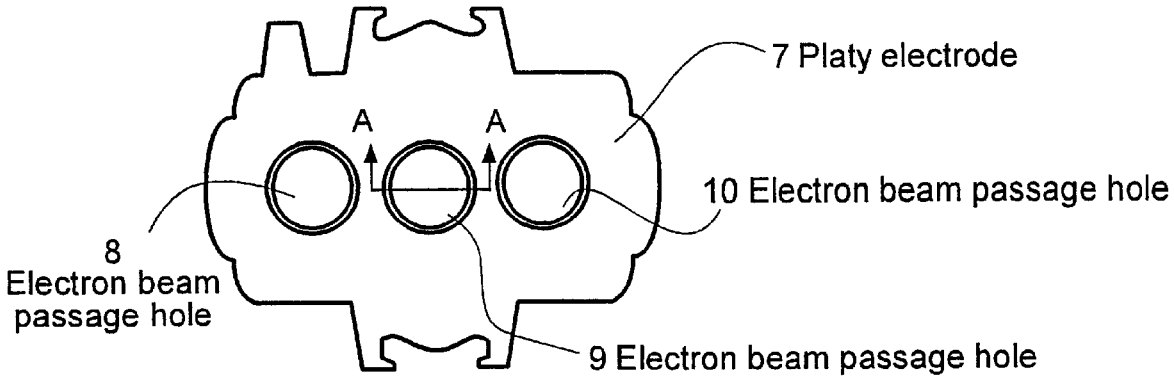
FIG. 2 is a plan view of a flat electrode according to one embodiment of the present invention.
Figure 3:
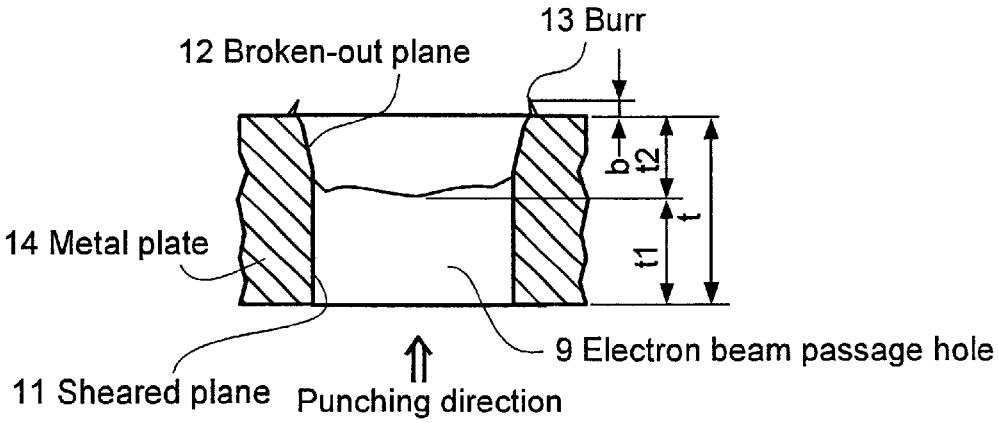
FIG. 3 is an enlarged sectional view of an inner surface of a hole punched according to the prior art.
Figure 4:
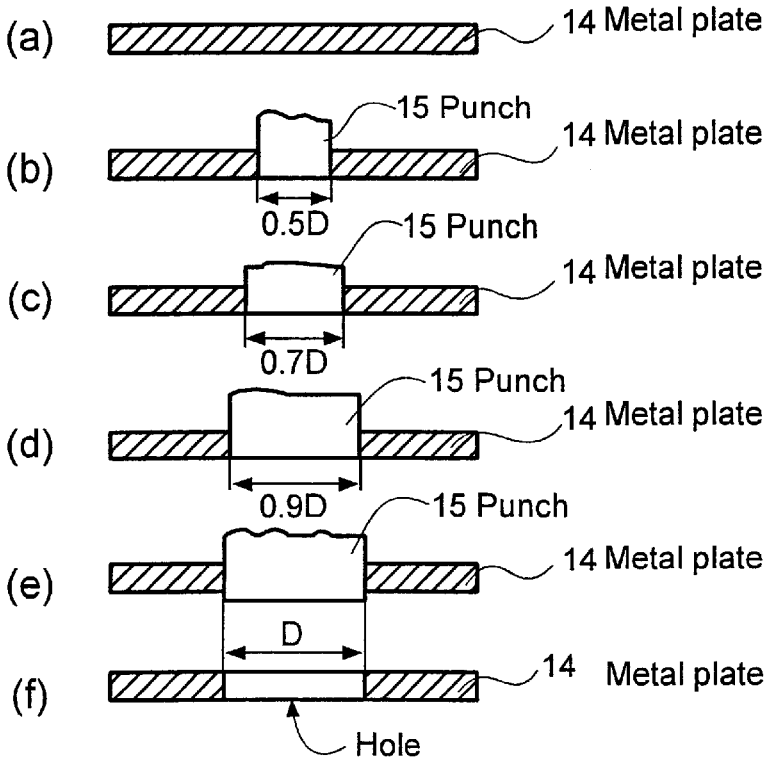
FIG.4 (Prior art)
FIG. 4 is a schematic process view of a shaving work according to the prior art.

FIG. 5(*a*) shows a sectional view of metal plate 14 and a die under half processing on the side of arrow-head line A—A for forming electron beam passage hole 9 of flat electrode 7 shown in FIG. 2.

In this case, die 23 with a hole diameter D1 of ø 4.00 mm for forming the half punched convex of metal plate 14, and half-off punch 17 with a punch diameter D2 of ø 4.04 mm were used so that the punch diameter can have a greater negative clearance relative to die diameter D1. Namely, as a clearance on the other side, punch diameter D2 of half-off punch 17 was made greater by 4% of the plate thickness than hole diameter D1 of die 23 on the other side.

In order to form the hole, metal plate 14 of Ni-Cr with a plate thickness t is prepared. Next, metal plate 14 is mounted on platform 19. Next, the press machine is operated to lower die 20. As die 20 starts to lower, platform 19 also lowers, and half-off punch 17 is pressed into metal plate 14, thereby forming half punched convex 9*a* in the central section of die 20, and half punched concave 9*b* on the half-off punch side. The press machine stops lowering die 20 in a middle section of the plate thickness t of metal plate 14. Die 20 stops lowering when half-off punch 17 lowers by 0.3 mm, corresponding to 60% of plate thickness t of metal plate 14, from the position where half-off punch 17 touches the surface of metal plate 17 (Refer to FIG. 5(*a*)).

Although the amount of lowering of die 20 in this half-off punching operation is allowed to come into such a range that half-off punch 17 gets pressed into the metal plate by 50–90% of the thickness of metal plate 14, in order to achieve a good through hole at the second punching process, it is desirable for the amount of lowering of die 20 to fall within a range of 55–65% of the thickness of metal plate 14 rather than a range of 50–90%. Incidentally, if the amount of lowering of die 20 in the half-off punching process is below 50% of the thickness of metal plate 14, a punching through failure might occur in the flat punching operation at the second processing stage.

Next, die 20 is lifted up, and metal plate 14 is moved to the following second processing stage. FIG. 5(*b*) shows a side sectional view for forming a through hole in the half punched convex 9*a* of the half-off punching product at the first processing stage. The die configuration includes a through punching die 22 on which half-off punched metal plate 14 is mounted, a plate keeper 23 for binding metal 14, a through punch 24 for punching a through hole, a pin 25 inside the through punch 24 for dumping out scarp from die 22, and a sponge 26 for pressing the pin 25.

FIGS. 5(*a*)–5(*d*) show the relationship between the dimensions of the punch and die and the diameters of the convex and concave sections of a half punched off hole. Although in this case the metal plate is punched using the punch with a diameter less than the diameter of the die used as shown in FIG. 5(*b*), the punch diameter may be greater than the die diameter. Further, the punch diameter maybe greater or less than the diameter of the half punched convex.

An operational procedure for the formation of a through hole is as follows. First, half punched metal plate 14 is mounted on through punching die 22. Next, the press machine is operated to lower plate keeper 23 and through punch 24 in this turn. Then, it is recommended to adjust the die operation so that lowering plate keeper 23 touches metal plate 14 first, and after that, through punch 24 touches half punched convex 9*a*, whereby when through punch 24 lowers, and half punched convex 9*a* gets pressed into the neighborhood of the flat surface of metal plate 14, through hole 9 is formed in metal plate 14, and scrap 9*c* is dumped out of through punching die 22 by pin 25.

By the two-process punching, an electron beam passage hole is formed in metal plate 14 as shown in FIG. 5(*d*). Hereinafter, regarding the hole shape to be formed at the second processing stage, the hole which is in contact with the side of through punch 24 at the second processing stage is referred to as a small- diameter side hole Ds, and the hole which is in contact with the side of through punching die 22 is referred to as a large- diameter side hole Dd.

With respect to the processing method above, a good electron through hole, with the small-diameter side hole Ds formed to have a diameter of 3.997 mm, the large-diameter side hole Dd formed to have a diameter of 4.07 mm, and no bur on the surfaces of metal plate and almost no broken-out surface on the inner surface of the hole, may be obtained.

With respect to the range of the difference in diameter between the small-diameter side hole and the large-diameter side hole, if the difference is within a range of 0.01t–0.4t relative to the plate thickness t, the difference has little effect on the withstand voltage characteristic of the focus lens (the focusing performance of a display with high definition and minuteness), thereby being within an acceptable range of the present invention.

Further, if the difference is within a range of 0.01t–0.2t, the difference can conform to the focusing performance or a display with much higher definition and minuteness, thereby being in a desirable range of the present invention.

In addition, although even this processing method sometimes caused a slight broken-out surface in the middle thickness of the metal plate on the small-diameter side, since the length of the broken-out surface was around 5% of the plate thickness t, the induction of the cold electron radiation could be suppressed, thereby does not significantly affecting the withstand voltage of the focus lens.

Figure 6:
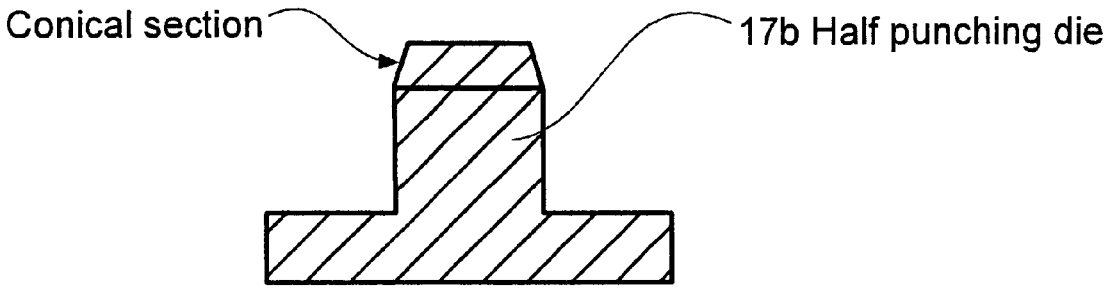
FIG. 6 is a partly modeled sectional view of die according to the first embodiment of the present invention.
Figure 7:
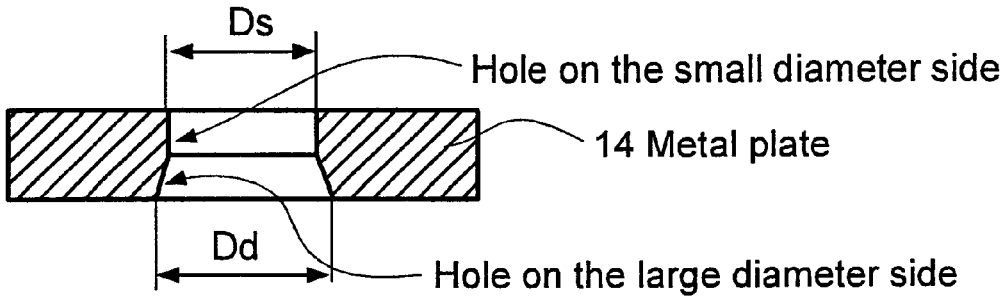
FIG. 7 is a modeled sectional view of an electron beam passage hole processed using a conical punch.

Additionally, although, in the description of embodiment 1, the cross-section of the half-off punching die was equally made in the vertical direction at the first processing stage, the tip section of the half-off punching die may be made conical as FIG. 6 shows. The electron beam passage hole which is processed using such conical half off punching die is formed as shown in FIG. 7.

Further, since the punch processing method according to the present invention, which was described for punch processing of electrode for electronic gun in embodiment 1, is the processing method for a metal plate without causing bur on the surface of the metal plate with less broken-out area on the inner surface of the hole, this processing method is not limited to punch processing of electrodes for electronic guns, but is applicable to general punching of metal plates.

Furthermore, the processing method of the present invention, which was described for the material of metal plate made of Ni-Cr alloy, is not limited to metal plate of Ni-Cr alloy, but is effective to any metal.

Moreover, the processing method of the present invention, which was described for a metal plate with a thickness of 0.5 mm, is not limited particularly to the plate thickness t, but is applicable to metal plate with other thickness.

Also, regarding hole diameters, although the description was made to set diameter D1 of die 23 to ø 4.00 mm and the diameter of half-off punch 17 to ø4.0, their diameters are not limited to these values.

Additionally, although the hole sectional shape was explained as being round, as long as a general press machine is used for the punch processing, the shape of a hole subject to the punch processing is not limited to being round. Other shapes such as elliptic and rectangular may be acceptable according to embodiments of the present invention.

Embodiment 2

In the case where a plurality of holes are punched by means of the processing method described in embodiment 1, particularly in the case where the flame width between adjacent holes is narrower than the hole diameter, embodiment 2 relates to the processing method for improving the tendency that the through holes on the large-diameter side become ellipses that can be seen after being formed at the second processing stage and to the processed flat electrode for an electronic gun.

Figure 8:
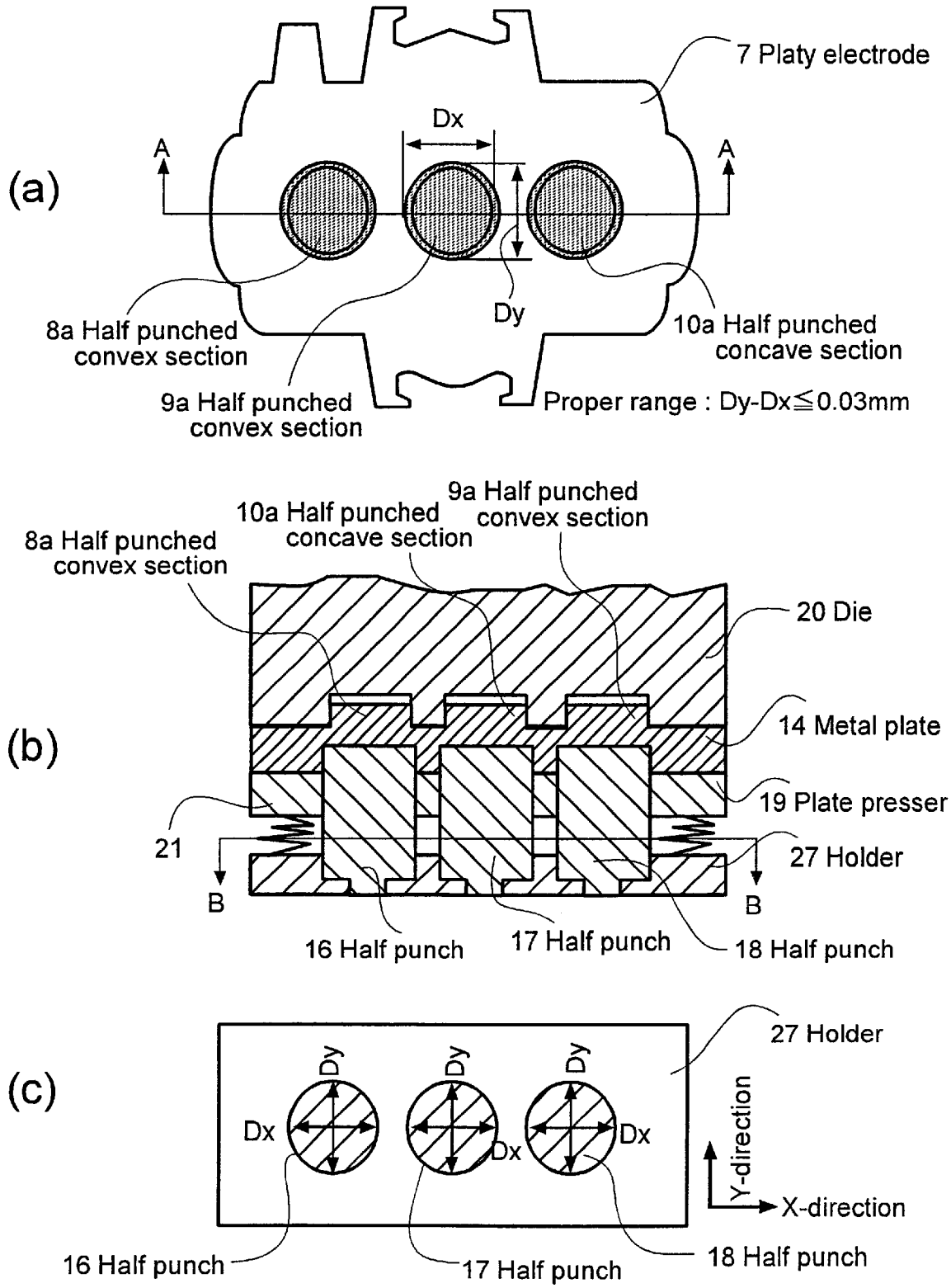
FIG. 8 is a plan view of a flat electrode and modeled sectional and plan views of a die assembly detailing a punching process according to a second embodiment of the present invention.

FIGS. 8(*a*)–8(*c*) shows a schematic view of a punch processing method according to embodiment 2. FIG. 8(*a*) shows flat electrode 7 having three holes, FIG. 8(*b*) a sectional view of the half-off punching die as viewed on arrow-head line A—A for forming the flat electrode shown in FIG. 8(*a*), and FIG. 8(*c*) a plan view of the half-off punch section of the half punching die shown in FIG. 8(*b*), respectively.

In FIGS. 8(*a*)–8(*c*), reference numeral 7 stands for a flat electrode, 8*a*, 9*a*, and 10*a* each stand for a half punched convex, numerals 16, 17, and 18 each a half-off punch, numeral 19 a plate keeping platform, numeral 20 a die, numeral 27 a half punch holder, numeral 21 a spring, distance Dx the X-directional (the direction in which adjacent holes line up) diameter of a half-off punch, distance Dy the Y-directional (the direction orthogonal to the Y direction) diameter of a half-off punch.

In embodiment 1, if a flat electrode having three holes that line up at a flame width of 1.5 mm between adjacent holes is formed at the first processing stage using dies with a diameter of 4.00 mm and half punches with a diameter of 4.04 mm, there can be seen a tendency that X-directional diameter dx of the central hole on the large-diameter side gets 4.07 mm, and Y-directional diameter dy of the central hole on the large-diameter side gets 4.13 mm. Hence the Y-directional diameter dy is greater than the X-directional diameter by as much as 0.06 mm (see hole section 9*a* of FIG. 8(*a*)). Holes 8*a* and 10*a* on both ends to central hole 9*a* on the large-diameter side also tend to become ellipses as is similar to the tendency of central hole 9*a*.

In this case, when the difference between the X-directional diameter and the Y-directional diameter exceeds 0.03 mm, it might have negative effects on the withstand voltage characteristic of the focus lens. Nevertheless, as for the difference in diameter of a hole that affects the withstand voltage characteristic of focus lens, for the diameter of the electron beam passage hole for the electronic gun disposed in electrode 7, the difference greater than 0.03 mm does not necessarily affect the withstand voltage, or the difference less than 0.03 mm may affect the withstand voltage, depending on the shape of the product.

Additionally, this tendency that affects the withstand voltage can be seen in the case when the flame width between the adjacent holes is less than ten times the plate thickness t, and further this tendency can be seen particularly often in the case when the flame width between the adjacent holes is less than five times the plate thickness t.

In contrast, when punching through three holes by a usual shearing method according to the prior art, such a tendency does not occur that the cross-section of the hole is formed to be remarkably elliptical as can be seen above. This is because the flame width between the adjacent holes is narrow, and the flame width section is elongated greater in the Y-direction than the X-direction at the half punching at the first processing stage. This elliptical deformation on the large-diameter side causes the distortion of the withstand voltage characteristic, thereby impeding the achievement of a high degree of resolution of the cathode-ray tube.

Embodiment 2 shows a method for improving the elliptical deformation on the large-diameter side.

The method for the improvement is to half-off punch the large-diameter hole with the use of a half-off punch having such an elliptical cross-section that the large diameter hole can be offset that was once made after through hole processing at the first processing stage of half-off punching in order to offset the large-diameter hole to have a good degree of roundness after the second formation processing stage.

In this connection, hole diameter D1 for forming the half punched convex of die 20 is ø 4.00 mm, each interval between adjacent holes of three is 5.5 mm, and the flame width is 1.5 mm. A good elliptical cross-section of the half-off punch was determined experimentally. Namely, hole diameter Dx of the half-off punch was set to 4.06 mm and Dy to 4.02 mm to form the half-off punch having such an elliptical cross-section that the X-directional hole diameter is greater than the Y-directional hole diameter.

In order to form the half-off punched hole, metal plate 14 of Ni-Cr with the plate thickness t is prepared as in embodiment 1. Next, metal plate 14 is mounted on platform 19, and the press machine is operated to lower die 20. The following procedure for operation is the same as that in embodiment 1. Die 20 is continuously lowered until half-off punches 16, 17, and 18 are made pressed into metal plate 14 as deep as 0.3 mm corresponding to about 60% of the plate thickness t of metal plate 14 (see FIG. 6(*b*)), and then die 20 is lifted up.

Although the amount of lowering of die 20 in this half-off punching operation, as in embodiment 1, may be within such a range that half-off punches 16, 17, and 18 are made pressed into metal plate 14 as deep as 50–90% of the plate thickness t of metal plate 14, in order to achieve a good through hole, it is desirable for the amount to be within a range of 55–65% of the plate thickness t.

Next, metal plate 14 is moved to the following second processing stage to form the through hole. The procedure for forming the through hole at the second processing stage is executed using the method and die structure as was explained in embodiment 1. Since the procedure for forming the through hole at the second processing stage is the same as that for embodiment 1, the procedure is omitted herein.

Figure 9:
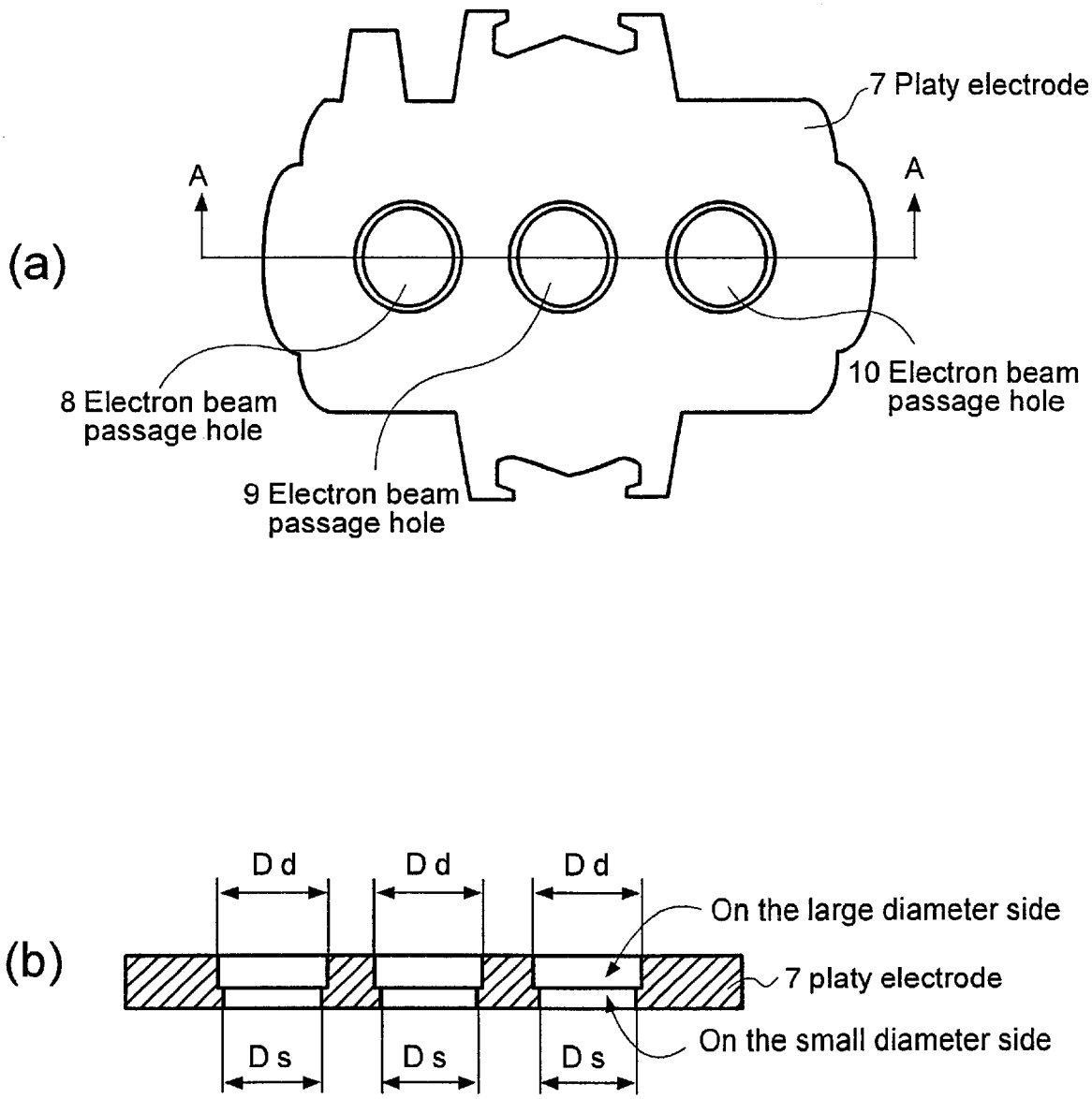
FIG. 9 is plan and sectional views of a flat electrode formed according to the second embodiment of the present invention.

The aforementioned procedure has accomplished the formation of an electron beam passage hole with a good degree of roundness of the hole diameter on the large-diameter side, no bur on the surface of the metal plate, and almost no broken-out inner surface of the through hole. FIG. 9 shows a flat electrode thus formed.

FIG. 9(*a*) shows a plan view of flat electrode 7 as viewed from the large-diameter side, and FIG. 9(*b*) a side sectional view of the flat electrode 7 shown in FIG. 9(*a*) as viewed from the direction of an arrow-head line A—A.

Further, although X-directional half punch diameter Dx was set to 4.06 mm (which is greater by 12% of the plate thickness t than the die diameter) and Y-directional half punch diameter Dy to 4.02 mm (which is greater by 4% of the plate thickness t than the die diameter) since these elliptical half punch diameters are appropriately variable depending upon the thickness of metal plate used, the diameters of through holes, and the flame width between adjacent holes, the ratio of X-directional half punch diameter Dx to Y-directional half punch diameter Dy, are not limited to a particular value.

Furthermore, electronic gun 4 in which flat electrode 7 which was formed according to the processing method could achieve a high resolution of cathode ray tube with less distortion caused in focus lens compared with an electronic gun of the prior art. In addition, the distortion caused in electric field could also be minimized.

As a result, the punching method of the present invention may be applied to color displays for use in personal computer or to color cathode-ray tubes for use in high definition and minuteness televisions, unlike the punching methods of the prior art.

Embodiment 3

Embodiment 3 is another punch processing method for protecting the hole diameter on the large-diameter side from becoming elliptical when half-off punching a plurality of holes which was explained in embodiment 2.

This method carries out half-off punching a plurality of holes onto a metal plate while protecting the metal plate from being elongated due to the narrow flame width between adjacent holes in the direction (Y direction) orthogonal to the direction in which the holes line up when carrying out half-off punching at the first processing stage. According to this method, at the same time when the electron beam passage hole is half- punched at the first stage, the Y-directional elongation of a metal plate is bound by half-off punching the peripheral section of flat electrode 7, thereby protecting the cross-section of hole from becoming elliptical.

Figure 10:
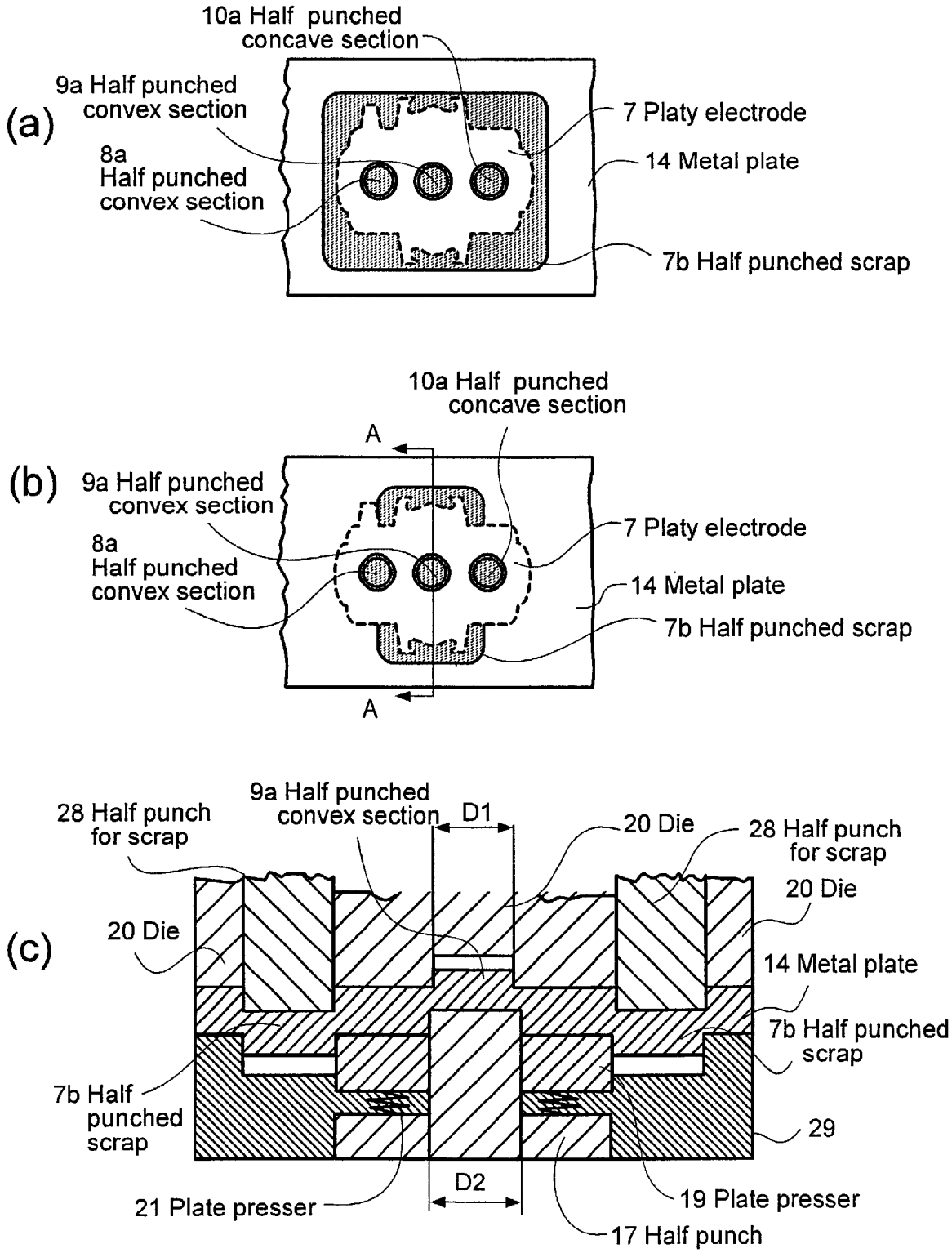
FIG. 10 is modeled plan views of metal plate and a modeled sectional view of die assembly detailing a punching process according to a third embodiment of the present invention.

FIG. 10 shows a schematic view of a hole punch processing method according to embodiment 3. FIG. 10(*a*) is a plan view showing a section of half punching three holes through which three electron beams pass and the case of half punching the whole peripheral section (7*b* of FIG. 10(*a*)) of flat electrode. FIG. 10(*b*) is a plan view showing a section of half punching three holes through which three electron beams pass and a part of the peripheral section (7*b* of FIG. 10(*b*)) of flat electrode, and FIG. 10(*c*) a side sectional view showing an outline of the half punching die for half-punching and a part 7*b* of the peripheral section shown in FIG. 10(*b*) at a time as viewed from an arrow-head line A—A.

In FIG. 10, reference numeral 14 is a metal plate, numeral 7 a flat electrode, numeral 7*b* a half-off punched scrap, numerals 8*a*, 9*a*, and 10*a* half punched convexes for allowing electron beams to pass through, numeral 20 a die, and numeral 28 half-off punch for scrap, respectively.

In this case, the diameter D1 of three holes of die was set to ø 4.00 mm, and each of the diameters D2 of half-off punches (16, 17, 18) to ø 4.04 mm, and half-off punch diameter D2 was made to have a negative clearance so as to be greater by 8% of the plate thickness t of the metal plate than the die diameter D1 (see FIG. 10(*b*)). Additionally, it should be noted that in the half-off punching formation, if the difference in dimensions between the half-off punch diameter D2 and die diameter D1 is +2% below the thickness of metal plate 14, the punching-off condition for scrap at the second processing stage becomes dull, and even if the difference exceeds +30%, the punching-off condition for scrap at the second processing stage also becomes dull.

Further, the half-off punch for the periphery of flat electrode 7 was made to be greater in diameter by 2% of the plate thickness t of metal plate 14 than the die facing the half punch. Furthermore, the intervals between three holes of die 22 was set to 5.5 mm, and the flame width to 1.5 mm.

The procedure for the formation, as in embodiment 1, is that metal plate 14 of Ni-Cr with a plate thickness t is mounted on platform 21, a press machine is operated to cause die 20 and scrap half-off punch 28 to process the metal plate. As die 20 and scrap half-off punch 28 start to lower, platform 19 lowers, whereby scrap half-off punch 28 is first pressed into metal plate 14, followed by being pressed into the periphery of flat electrode 7, and at almost the same time when half-off punch 17 is pressed into metal plate 14 to half-punch the half punched hole convex and the periphery. Lowering die 20 and scrap half-off punch 28 stops when half-off punch 17 is pressed into metal plate 14 as deep as 0.3 mm corresponding to 60% of the plate thickness t of metal plate 14 from the surface of the metal plate (see to FIG. 7 (*c*)). Although the amount of pressing down half punch 17 into metal plate 14 may be in a range of 50–90% of the plate thickness t, it is preferably in a range of 55–65% of the plate thickness t.

Moreover, although the amount of pressing down scrap half punch 28 into metal plate 14 may be in a range of 5–90% of the plate thickness t of metal plate 14, and in order to reduce the warp of flat electrode, it is preferably within a range of 5–30% of the plate thickness t.

Next, lift up die 20 and scrap half-off punch 28.

Next, move metal plate 14 to the second processing stage to punch out through holes for passing electron beams. The second processing stage uses dice that can punch three holes having the same structure at a time as is similar to that explained in embodiment 1 (see to FIGS. 5(*b*) and (*c*)). The detailed explanation of which is omitted herein. Next, at the third and the following processing stages, the periphery of flat electrode 7 is removed from metal plate 14. This peripheral cutting may be done in the usual punch off manner.

In addition, to prevent occurrence of burs by the peripheral cutting, firstly, half-punch the whole periphery of the flat electrode at the first processing stage as shown in FIG. 10(*a*), secondly, at the second and following processing stages use a die having the structure similar to that of the die used at the second processing stage to punch off half punched scrap section 7*b* projected at the first processing stage, thereby being able to achieve a smoothly finished side of flat electrode without bur.

By the above method, electron beam passage holes on the large-diameter were formed having a good degree of roundness, no bur on the surface of the metal plate, and almost no broken-out area on the inner surface of the holes.

Additionally, in embodiment 3, although scrap half-off punching was executed in the direction opposite to the direction of half punching the electron beam passage holes, this half punching direction for scrap half punching may, of course, be executed in the same direction as that done for electron beam passage holes without any problem.

Further, although according to the description of embodiment 3 half punch processing at the first stage was executed on the periphery of the flat electrode, the half-off punching may be applied to the outer section beyond the periphery.

Furthermore, although according to embodiment 3 the convex and concave sections of the periphery of the flat electrode was formed by half-processing, these sections may be executed by coining at this first stage. Leaving of convex and concave shapes in the convex and concave section by coining may be executed on one or both sides of metal plate 14.

Moreover, even if the half-processed or coined section at the first processing stage is formed in flat electrode 7, good shaped holes can be achieved unless there are problems with the configuration and performance of the flat electrode.

Additionally, in a cathode-ray tube with electronic gun 4 in which flat electrode 7 made according to the method was incorporated, less distortion was caused in a focus lens compared with methods by the prior art, and hence the withstand voltage characteristic according to the method was enhanced, thereby being able to achieve a high resolution of the cathode-ray tube. The distortion which was caused in electric field could also be made small.

As a result, the hole punching method by usual punching according to the prior art could not be easily applied to color displays for use in personal computers and cathode-ray tubes for miniature televisions. However, the method according to the present invention has made it possible to apply its punching methods to the above devices, thereby satisfying the needs of the technological trend toward minute devices.

Embodiment 4

Embodiment 4 is another processing method for protecting the cross-sections of holes on the die-diameter side from becoming elliptical when half-processing a plurality of holes as explained in the previous embodiments.

This method is to execute half-off punching of the electron beam passage hole section while protecting the flame from being elongated due to a narrow flame width between adjacent holes when executing half processing at the first stage in the direction (Y direction) orthogonal to the direction (X direction) in which a plurality of holes line up. This method is to impede the Y-directional elongation of the flame width section of a metal plate by punching out the whole or part of the periphery of the flat electrode while half-off punching the electron beam passage holes at the first stage of half punching process to protect the cross-sections of the holes from becoming elliptical.

Figure 11:
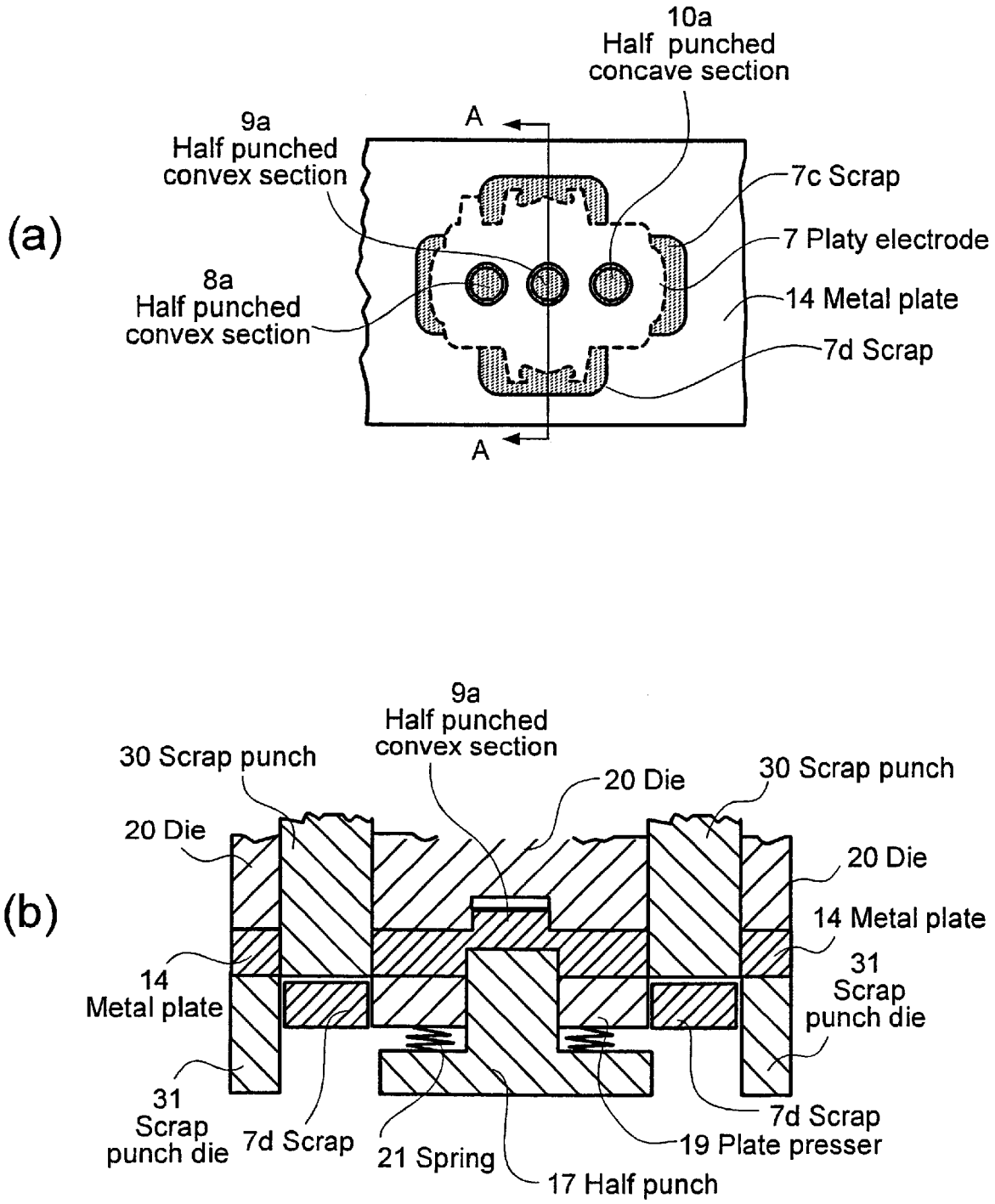
FIG. 11 is a modeled plan view of a metal plate, and a modeled sectional view of die assembly detailing a punching process according to a fourth embodiment of the present invention.

FIG. 11 shows a schematic view of the punch processing method shown in embodiment 4. FIG. 11(*a*) shows the section of half-off punching three holes for allowing electron beams to pass through, and the case (a plan view) of cutting off the peripheral sections which are part of flat electrode 7, FIG. 11(*b*) is a side sectional view showing an outline of half-off punching die as viewed from an arrow-head line A—A for punching off part 7*d* of the periphery shown in FIG. 11(*a*) at a time.

In FIG. 11, numerals 7*c* and 7*d* are scrap, numeral 30 a scrap-off punch, and numeral 31 a scrap-off die, respectively.

In this case, as in embodiment 3 the diameters D1 of three holes of die 20 were each set as ø 4.00 mm, the punching diameters D2 of half-off punches (16, 17, and 18) each was set to ø 4.04 mm, and the half-off punch diameter D2 was provided with a negative clearance which is greater by 8% of the plate thickness t of metal plate 14 than die diameter D1. Further, the punch for punching off the periphery of the flat electrode was made smaller by 2% of the thickness of metal plate 14 than the die facing the punch. Furthermore, the intervals between adjacent holes of three were set to 5.5 mm, and the flame width to 1.5 mm, respectively.

The procedure for the formation of a metal plate is, similarly to that in embodiment 1. That is, metal plate 14 of Ni-Cr alloy with a thickness of 0.5 mm is mounted on platform 19, and then a press machine is used to lower die 20 and scrap-off punch 30. As die 20 and scrap-off punch 30 start to lower, platform 19 lowers and then scrap-off-punch 30 is first pressed into metal plate 14 and the periphery of flat electrode 7. At almost the same time, half-off punch 17 is pressed into metal plate 14, whereby half punched convex 9*a* is formed and the periphery is punched off. Lowering die 20, stopped when half-off punch 17 contacts the surface of metal plate 14 and is pressed into metal plate 14 as deep as 0.3 mm, which corresponds to 60% of the plate thickness t of metal plate 14. Then, scrap-off punch 30 continues processing until scrap 7*d* is completely punched off from metal plate 14 (see to FIG. 5(*b*)). Lift die 20 and scrap-off punch 30.

Additionally, in this case, as in embodiments 1–3, although the amount of pressing down half-off punch 17 into metal plate 14 may be in a range of 50–90% of the plate thickness t, it is preferable to make the amount fall within a range of 55–65% of the plate thickness t.

Next, move metal plate 14 to the following second processing stage to punch out through holes. At this second processing stage, the dice that can punch out three holes have the same structure as explained in embodiment 1 (see FIGS. 5(*a*) and (*b*)) are used in the same manner as before. The detailed procedure is omitted herein. At the third and following stages the periphery of flat electrode is cut off from metal plate 14. This periphery may be cut off in a usual punching-out manner.

According to the method, electron beam passage holes were formed on a metal plate with a good degree of roundness on the large-diameter side, with no bur on the surface of the metal plate and almost no broken-out area on the inner surfaces of the holes.

Additionally, a cathode-ray tube with an electronic gun incorporating the flat electrode 12*a* which was formed according to the method, similarly to those formed in embodiments 2 and 3, had less distortion caused in the focus lens, thereby being able to enhance the withstand voltage characteristic and to achieve a high resolution compared with those produced according to the prior art. Also, the distortion which was caused in electric field could be reduced.

As a result, flat electrodes which were produced according to the present invention were applicable to color displays for personal computers or cathode-ray tubes for miniature televisions, whereas those which were produced according to the prior art were not applicable thereto.

Further, although it was explained in embodiments 2 through 4 that the methods according to the present invention relate to means for protecting holes on the large-diameter side from becoming elliptical when punching a plurality of holes in a flat electrode of electronic guns, these means are not limited to hole punching for electronic gun, but are effective in the methods for punching a metal plate having a plurality of holes.

Embodiment 5

Embodiment 5 relates to the method for punching holes having different hole pitches and shapes in the processing method for punching a plurality of holes in a metal plate explained in embodiment 1 and to flat electrodes for electronic guns with different hole pitches on both surfaces of the metal plate.

Figure 12:
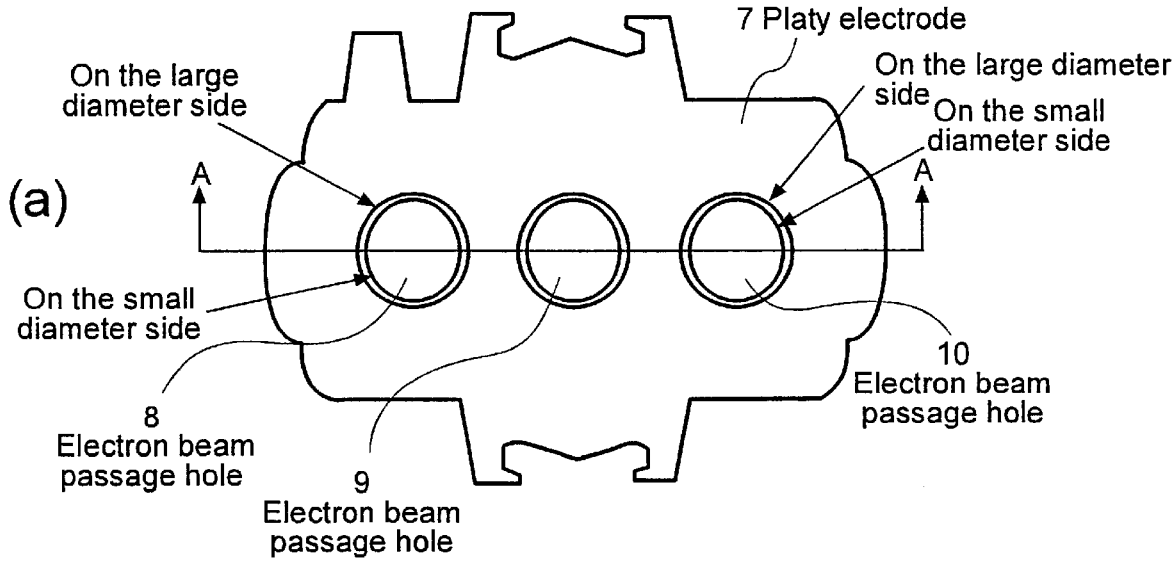
FIG. 12 is plan and sectional views of flat electrode according to an embodiment of the present invention.
Figure 12:
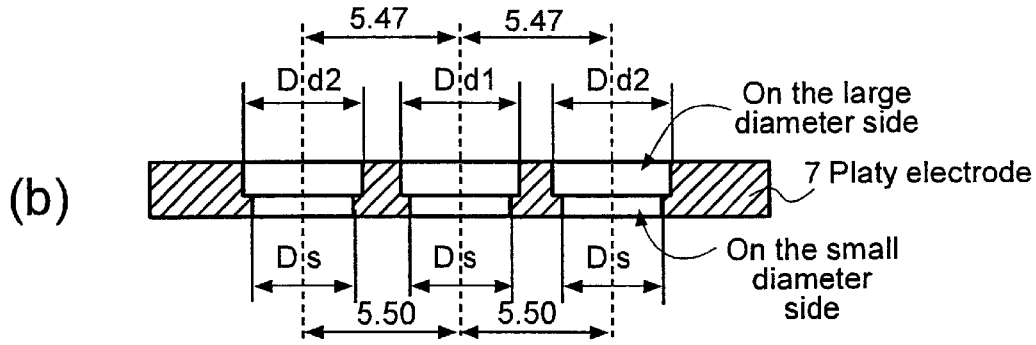
Figure 13:
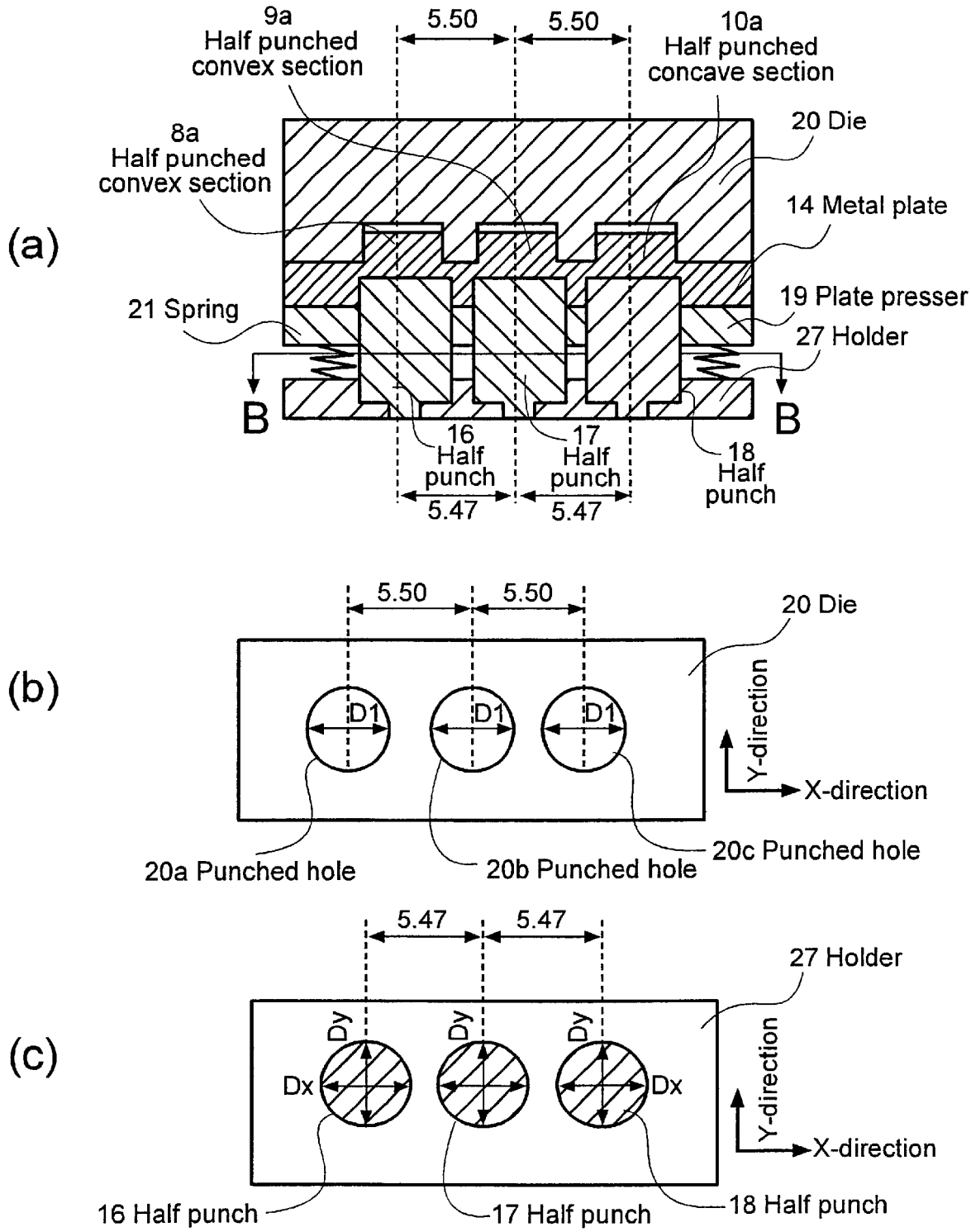
FIG. 13 is modeled sectional views of a die assembly showing the punching process on a flat electrode according to a fifth embodiment of the present invention.

FIG. 12 shows a schematic view of flat electrode 7 with different hole pitches and shapes on both surfaces thereof in embodiment 5. FIG. 12(*a*) shows a plan view of flat electrode 7 having three holes different in hole pitch and shape, and FIG. 12(*b*) shows a sectional view of the hole section of the flat electrode shown in FIG. 12(*a*), respectively. FIG. 13(*a*) shows a sectional view of a half-off die for forming the flat electrode shown in FIG. 12(*a*) as viewed from an arrow-head line A—A, FIG. 13(*b*) shows a plan view of the hole section of the die, and FIG. 13(*c*) shows a plan view of the half-off punch section of the half-off die.

Electronic guns for miniature color cathode-ray tubes uses an electrode having such a structure that side electronic beams are bent into the center electron beams by the main electrode so that three electron beams can be focused on the central section of the fluorescent surface. In this case, as shown in FIG. 12, the electrode is used wherein the hole pitch on the electron-beam exit side (large-diameter side) of electron-beam passage holes 8, 9, and 10 is smaller than the hole pitch on the electron-beam entry side (small-diameter side) thereof, and wherein two holes of both ends (electron-beam passage holes 8 and 10) on the exit side are elliptical.

In order to form such a flat electrode that the hole pitch on one surface of the electrode is different from that on the other surface thereof, or that the hole pitch and shape thereon are different from each other, according to the prior art two metal plates were used, of which one is processed to have holes for the entries of electron beams and the other is processed to have holes for the exits of electron beams, and after that these two metal plates were stuck together to form one electrode.

In order to resolve the aforementioned problem, the embodiment of the present invention provides a novel processing method for forming one flat electrode having holes of which the hole pitch and shape on one surface thereof are different from those on the other surface thereof.

As to a novel method for punching a hole of which the hole pitch on one surface thereof is different from that on the other surface thereof a more concrete embodiment is shown. The processing method is that a press machine of which the pitch of three punches is made different from the pitch of three dies is used at the first half punching stage so as to form holes of which the hole pitch on one surface of metal plate is different from that on the other surface thereof. In this case, the hole diameters D1 of die 20 as shown in FIG. 13(*b*) for forming holes on the small-diameter side each are ø 4.00 mm, the pitch of each of the three holes is 5.5 mm, and the flame width between adjacent holes is 1.5 mm. The X-directional hole diameters Dx of half-off punches as shown in FIG. 13(*c*) were set to ø4.04 mm for the central hole and to ø 4.12 mm for each of the two holes on both ends. The pitch of three holes were set to 5.47 mm, and the Y-directional hole diameters Dy to ø 4.04 mm for all of three holes, whereby the three holes were punched so that the diameters Dx of the two holes at both ends on the large-diameter side are elongated toward the central hole.

For the formation, similarly to embodiment 1, metal plate 14 of Ni-Cr alloy with a thickness of 0.5 mm was prepared.

Next, the metal plate 14 was mounted on platform 19, a press machine used is operated to make die 20 process the metal plate. The following processing method is the same as embodiment 1, wherein die 20 is lowered until half-off punches 16, 17, and 18 are pressed into metal plate 14 as deep as 0.3 mm corresponding to about 60% of the plate thickness t thereof, and then die 20 is moved up.

Next, the metal plate 14 is moved to the second processing stage, whereat the metal plate is formed to have through holes. The formation at the second processing stage is executed using the procedure and die structure explained in embodiment 1. Since this method for the formation is the same as that of embodiment 1, the explanation is omitted herein.

A flat electrode for an electronic gun in which the hole pitch on the large-diameter side is different from that on the small-diameter side has been formed into one sheet of metal plate according to the aforementioned procedure. FIG. 12 shows a configuration of the thus formed flat electrode.

Additionally, although the example of embodiment 5 was explained making the hole pitch on the large-diameter side different in 0.03 mm from the small-diameter side, the difference in hole pitch is not limited to a particular value. In embodiment 5, a sample used is a plate having a plurality of holes through which electron beams from electrodes of an electronic gun pass, and in the case where there exists a difference in hole pitch between the upper surface and the lower surface if the ratio of the difference in hole pitch on the upper surface to that (ratio of 1) on the lower surface is in a range of 0.95–1.05, the image display is within the most effective range, wherein the side beams can be bent and moved beside the center beam, thereby being able to focus beams on a dot of highly minute display panel.

Further, although even the elliptical shape on the large-diameter side was explained in embodiment 5 setting Dx to ø 4.12 mm, Dy to ø 4.04 mm, and the difference between Dx and Dy to 0.08 mm, this elliptical shape is not limited to a particular value. In this embodiment, if in an electrode which is formed of one sheet of flat electrode for electronic gun of cathode-ray tube, the elliptical ratio (the ratio of the major diameter to the minor diameter) of the elliptical hole on the exit-side of electron beam is in a range of 1.002–1.08, the flat electrode is within a range of the present invention, thereby being able to bend the side beams effectively to the center beam.

In the processing method of the present invention, such a flat electrode as shown in FIG. 12 is also formed having a hole shape that the difference in hole pitch between the small-diameter side and the large-diameter side is as large as around 0.2 mm, and the difference in diameter between Dx and Dy of elliptical shape is as large as around 0.2 mm.

Further, in embodiment 5, although a half punch forming method was shown in order to form a metal plate having a different hole pitch between both surfaces thereof, another processing method other than the aforementioned may be used to form the metal plate. For example, through holes are formed by the usual punching off method (using punch and die) of the prior art at the first processing stage on the small-diameter side, followed by using an elliptic die with a hole pitch different from that used at the first processing stage and an elliptic punch to half punch, thereby being possible to punch holes having the shape.

Embodiment 6

Figure 14:
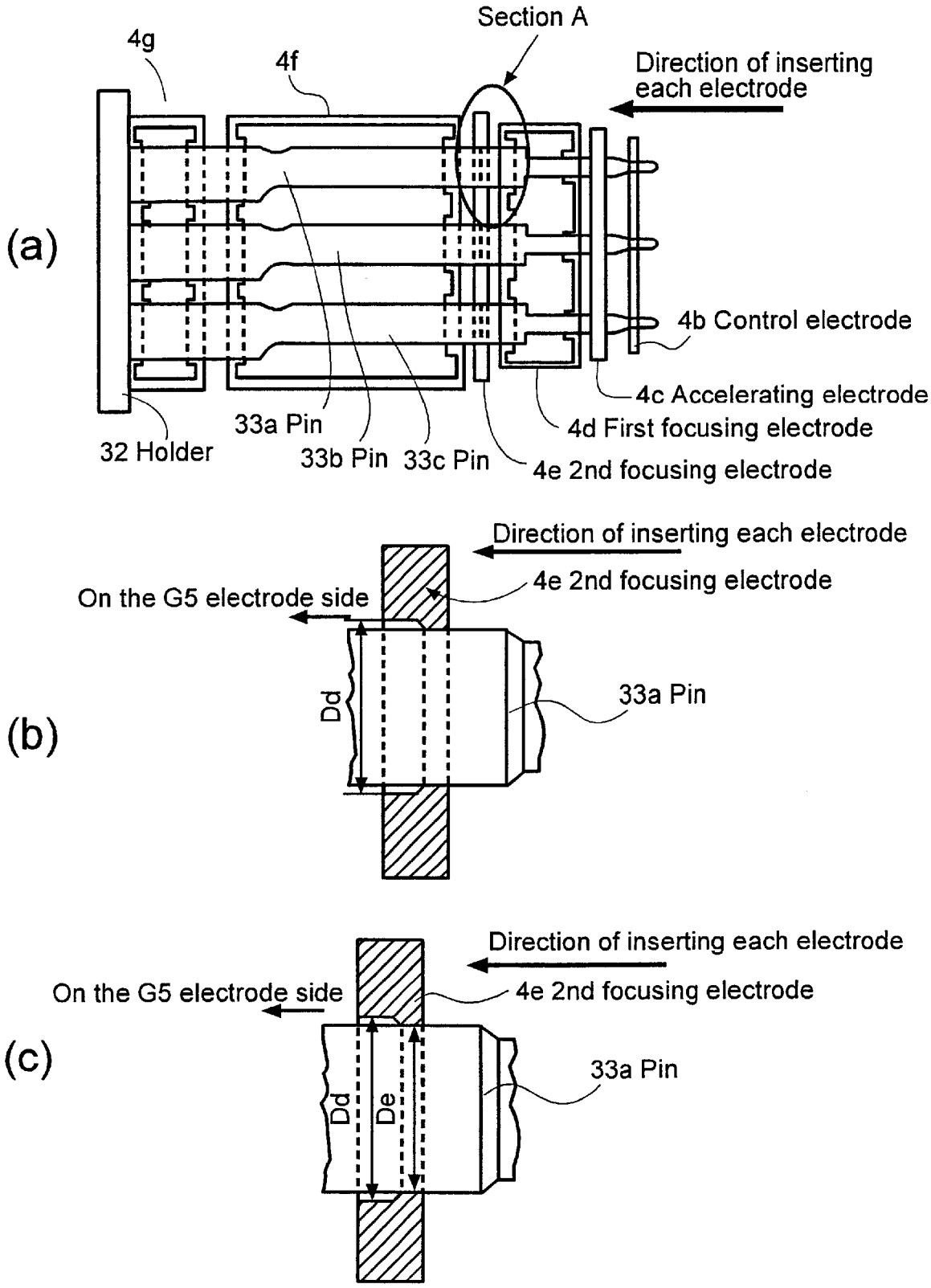
FIG. 14 is a sectional view of an assembly jig for assembling flat electrodes into an electronic gun and modeled sectional views of a die.

Next, an embodiment is explained for assembling the flat electrode produced for electronic gun in the aforementioned embodiment thereinto. FIG. 14(*a*) shows schematic view of a jig for assembling an electronic gun and a flat electrode of electronic gun, FIG. 14(*b*) shows a configuration of G4 flat electrode 4*e* punched out by the conventional and stepped pin 33*a*, and FIG. 14(*c*) shows a configuration of G4 flat electrode 4*e* having two stepped hole shape and stepped pin 33*a*. The assembly jig consists of a holder 32 and three stepped pins 33*a*, 33*b*, and 33*c*.

The procedure for assembling an electronic gun is executed, as shown in FIG. 14(*a*), by inserting, namely, fitting, each flat electrode in stepped pins in turn starting from the flat electrode closest to the fluorescent surface of cathode-ray tube.

In the assembly of this flat electrode, when assembling flat electrode 4*e* formed by means of usual punching of the prior art as shown in FIG. 14(*b*), in order to make the assembly easy, the broken-out surface side having a larger hole diameter is taken to the exit side of an electron beam, followed by- inserting pins in the flat electrode. Because in this prior art the condition of the inner surface of the holes is not good due to the presence of bur on the exit side and broken-out surface, the emission of cold electron is induced, thereby reducing the withstand voltage characteristic.

Accordingly, in the prior art if the reduction of the withstand voltage characteristic becomes large in the assembly in the conventional direction (FIG. 14(*b*)), G4 flat electrode 4*e* was taken upside down, and then was inserted in stepped pin 33*a* from the small-diameter side having no bur (not shown in the drawing).

In this case, although because the small-diameter side with less bur turns to the fluorescent surface side of miniature cathode-ray tube, the withstand voltage characteristic is generally enhanced compared with the case of not taking the flat electrode up-side down, the following problem arose. Namely, because the clearance between the outer diameter of stepped pin 33*a* and the hole diameter (Ds) on the small-diameter side was designed to be very small for the necessity of enhancing the assembly precision of electronic gun, it was hard to insert pin 33*a* in flat electrode 4*e*. Further, because setting of an appropriate position of inserting pin 33 was also hard, when inserting pin 33*a* in the flat electrode, pin 33*a* rubs against the inner surface of the electrode so as to scratch the inner surface (the inner surface on the small-diameter side having no bur) of electrode hole, and the scratch caused the problem of lowering the withstand voltage characteristic, thereby causing a decline of the yield of the product.

When assembling flat electrode 4*e* according to the present invention, because there is no bur on both surfaces of the hole as show in FIG. 14(*c*), it is not necessary for the assembly to take the flat electrode up-side down as aforementioned.

Accordingly, flat electrode 4*e* can be inserted in pin 33*a* keeping the condition that the large-diameter side (Dd) is on the fluorescent surface side, whereby the clearance between the inner surface of the large diameter of flat electrode 4*e* which is the entry of insertion and pin 33*a* can be made large so that the position of inserting pin 33*a* can be easily set, thereby making the assembly of electronic gun easier compared with the conventional method. Further, easy insertion of pin 33*a* reduced the phenomenon that pin 33*a* rubs against the inner surface of the hole of flat electrode 4*e* to cause scratch thereon. Accordingly, such a case could be radically reduced that a decline of the withstand voltage characteristic is brought about by scratch, etc. on the inner surface of hole during the assembly of electronic gun, thereby contributing to the enhancement of the yield of electronic gun.

Embodiment 7

Figure 1:
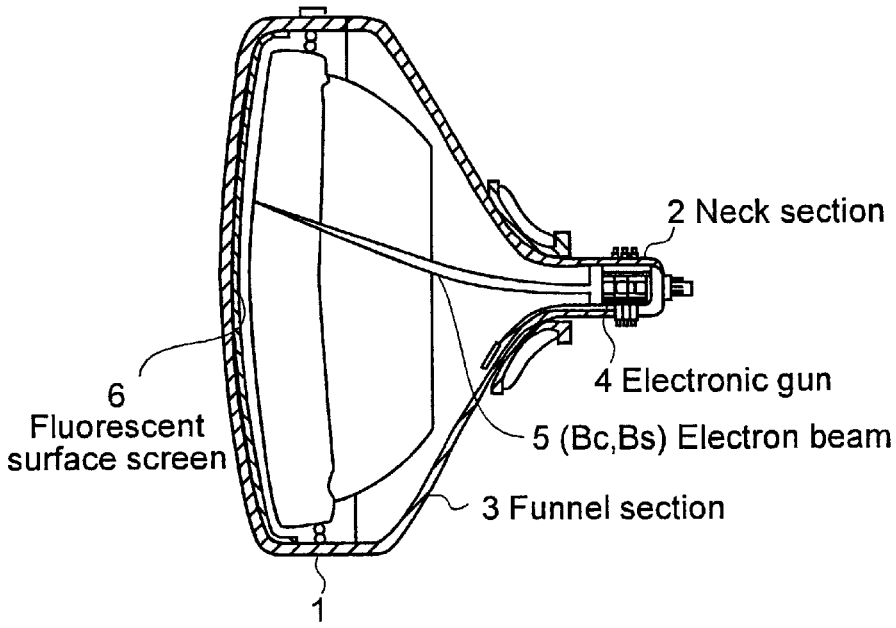
FIG. 1 is a sectional view of an electronic gun and a color cathode-tube according to one embodiment of the present invention.

Next, an embodiment of the display unit is explained that was produced according to the aforementioned embodiment using a metal plate for an electronic gun is explained. The display unit is represented with color displays for use in ordinary home televisions and personal computers. These display units use cathode-ray tubes for monitors. In electronic gun 4 of color cathode-ray tube shown in FIG. 1, a metal plate formed by the aforementioned embodiment is mounted.

Because the image display of a display unit is required to have a high brightness and resolution, a method is used for raising the voltage applied to each electrode of the electronic gun to accelerate an electron beam.

For example, an electronic device consuming a relatively large amount of electric current such as an electronic gun for an ordinary home television consumes electric current on average up to 0.8A–1.0A. The repulsion between electron beams is so great that the electron beam flux becomes large, and the beam flux diameter cannot be made small, thereby being unable to respond to a required high resolution of the display unit unless another means is introduced. To this end, the voltage of the main lens electrode (G3–G6: multistage electronic gun) is raised to accelerate electron beams, whereby the repulsion is made small. As a result, the electron beam flux is made small, enabling a high resolution to be obtained.

Further, in another electronic device consuming a relatively small amount of electric current such as an electronic gun for a computer display monitor where the consumption of average electric current is as small as 0.2A–0.3A, the problem of repulsion between electron beams is less of an issue. In this case, by raising the voltage to enhance the energy of each electron beam, the light emitting brightness of the fluorescent substance can be made high, whereby the electric current consumption can be reduced for the same brightness, thereby being able to make the beam spot diameter small. Namely, the resolution can be enhanced by less electric current while maintaining a required high brightness.

Figure 15:
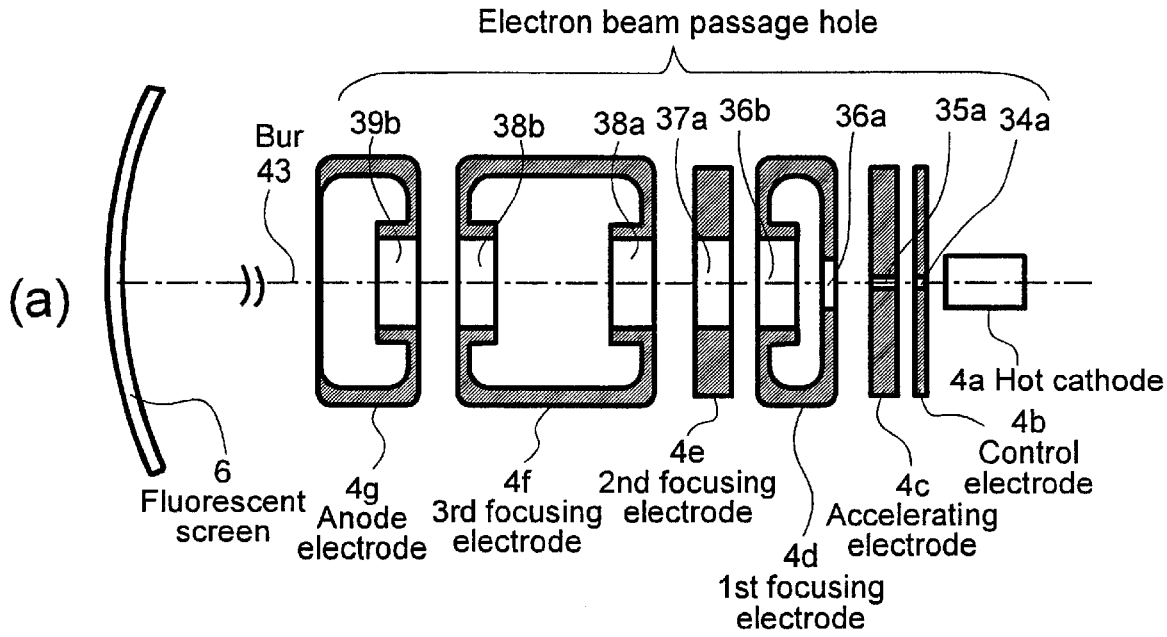
FIG. 15 is modeled block diagrams of electrodes constituting an electronic gun detailing the focus voltage characteristics of the electronic gun in which flat electrodes are incorporated.
Figure 15:
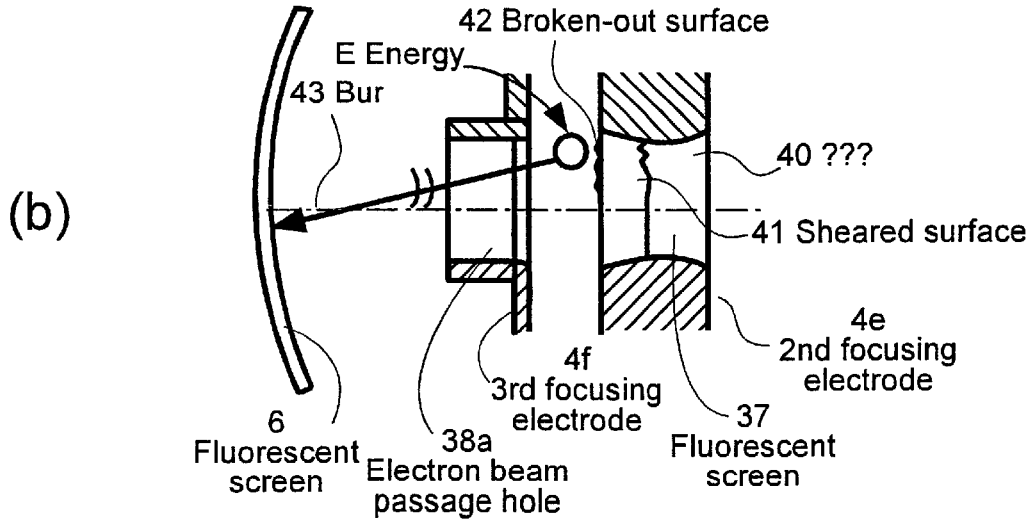

FIG. 15 shows a block diagram of the embodied example of an electronic gun for a cathode-ray tube where FIG. 15(*a*) is a sectional view of the electronic gun, and FIG. 15(*b*) is an enlarged view of electrode parts according to embodiment 7. In this figure, numeral 4*a* is a hot cathode, numeral 4*b* is a control electrode, numeral 4*c* is an accelerating electrode, numeral 4*d* is the first focusing electrode, numeral 4*e* is the second focusing electrode, numeral 4*f* is the third focusing electrode, numeral 4*g* is an anode electrode, and numerals 34*a*, 35*a*, 36*a*, 36*b*, 37*a*, 38*a*, 38*b*, and 39*a* are electron beam passage holes. To each of the electrodes, the following voltages are applied, namely, 0–100V to control electrode 4*b*, 300-1 kV to accelerating electrode 4*c* and the second focusing electrode 4*e*, 5–8 kV which is the medium potential voltage as focus voltage to the first focusing electrode 4*d* and the third focusing electrode, and approximately 20–30 kV to anode electrode 4*g*, and the interval between adjacent electrodes is in a range of 0.6–1.0 mm. Electron beams which are emitted from the cathode are accelerated along central axis 44, and are focused by the static lenses constituted by each electrode, thereby exciting fluorescent screen 6 to emit light thereon.

Since the second focusing electrode 4*e* usually uses a flat electrode due to a required length of the electrode, the existing product is formed using a usual punching press as shown in the upper section of FIG. 15(*b*). The usual punching press part consists of sheared surface 41 and broken-out surface 42 as aforementioned, and has fine bur 43 in the short section of the opening on the side of broken-out surface. Because this bur 43 is sandwiched between the first focusing electrode 4*d* and the third focusing electrode 4*f* to both of which the voltage which is applied to the opposite electrode of the second focusing electrode 4*e* is greater than that applied to the second focusing electrode 4*e* is applied, electric field is easily focused on the short section of the opening on the side of broken-out surface, wherein the phenomenon that cold electron is emitted from the tip of the bur 43. As a result, a problem arises with the quality of the usual punching press part that emitted cold electron passes through the opening of the third focusing electrode 38*a* to excite fluorescent surface 6 of cathode-ray tube to emit light thereon.

Figure 16:
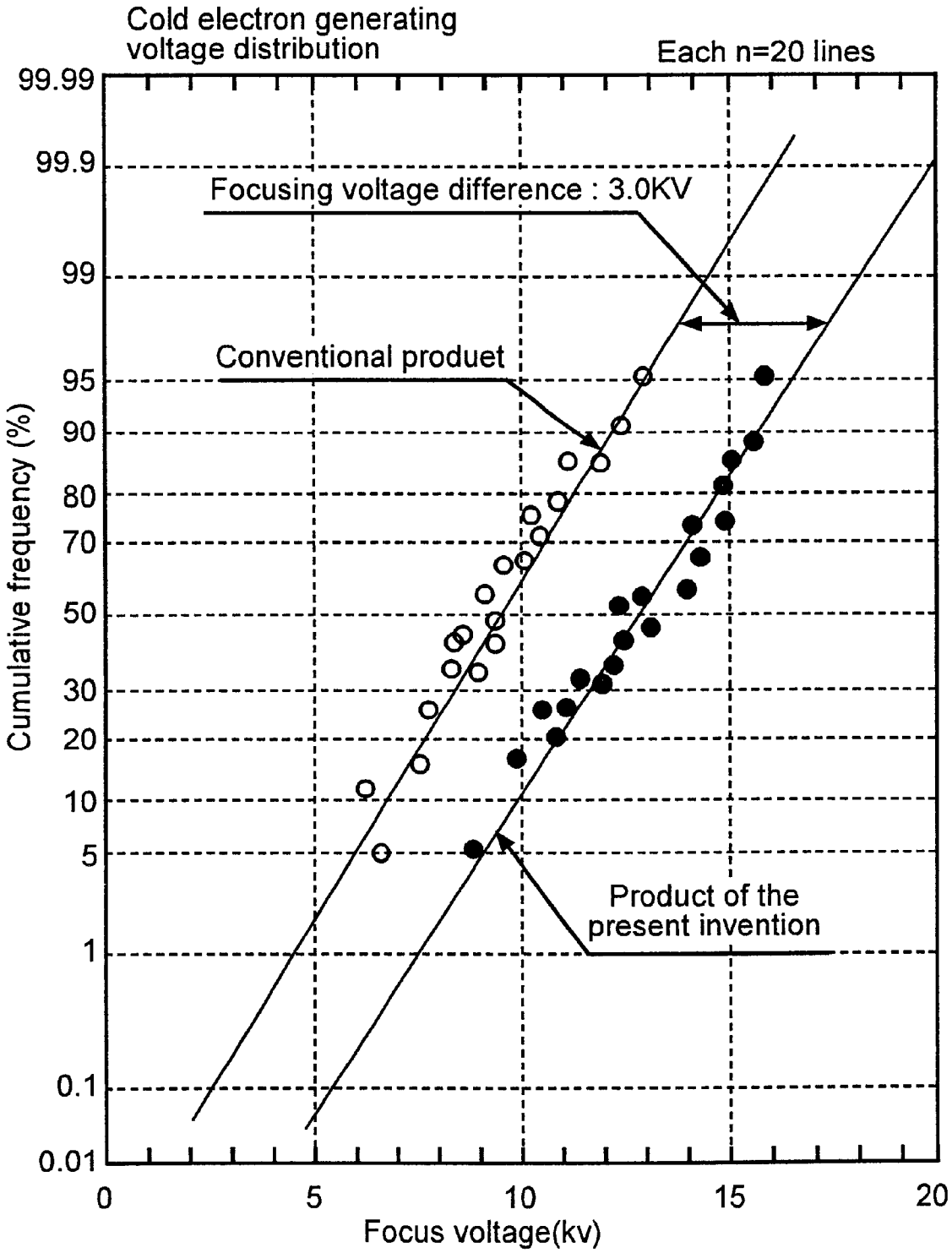
FIG. 16 is a comparison diagram on focus characteristics between an electronic gun according to one embodiment of the present invention in which flat electrodes are incorporated and a conventional electronic gun.

FIG. 16 shows the distribution of the light emission initiating voltage on the fluorescent surface by cold electron emitted from the existing second focusing electrode formed using a conventional usual punching press and that by cold electron emitted from flat electrode 7 formed using the upper and lower surface punching press according to the present invention. Although the light emission by cold electron has a distribution to some extent on the fluorescent surface due to a dispersion of production of cathode-ray tube, when comparing the difference in the average light emission voltage (50% line) by the presence or absence of bur in the second focusing electrode 4*e* between the usual punch pressed electrode (existing electrode) and the upper and lower surface punch pressed electrode (flat electrode 7 by the present invention), the flat electrode 7 by the present invention can raise the light emission voltage by 3 kV compared with the existing electrode by the prior art, namely, the light emission voltage by the conventional punch pressed electrode indicates 10 kV, while that by the flat electrode 7 by the present invention indicates 13 kV. Further, also as to the distribution of light emission on the fluorescent surface, when the focus voltage at the first focusing electrode 4*d* and the third focusing electrode 4*f* in actual operation is in a range of 5–8 kV, the ratio of the occurrence of light emission on the fluorescent surface by the upper and lower surface punch pressed flat electrode according to the embodiment 7 is below 1%, whereby a radical quality improvement of lowering the ratio of the occurrence of light emission on the fluorescent surface has been made sure, whereas the ratio by cold electron emission from the usual punch pressed electrode still remains in less than 20%.

In the present invention, as aforementioned, the product is constituted by disposing metal plate with less bur for electronic gun in cathode-ray tube and display unit, thereby being able to realize image display with a high resolution while sustaining a high brightness condition that are the purpose of the present invention.

According to the electron beam passage hole punching method for electronic gun by the present invention, the inner surface of the hole has almost sheared surface and hence can achieve a very fine inner surface. Further, because punching is executed from both surfaces of metal plate, bur, which was generated by the conventional processing method on the exit side of punching, is not generated at all, whereby the process of removing bur (barrel grinding) following punching process as often required of the conventional method can be eliminated and hence the processing cost can be reduced.

Furthermore, because die wear or shear drop in the peripheral section of the hole can be eliminated by the bur removal grinding, the focus characteristic deterioration has also been eliminated.

The high precision hole shape processing makes it possible to heighten the electric field of focus lens to ideal level, thereby being able to produce electronic gun having high resolution.

As a result, because in the conventional usual hole punching method, it is hard to apply the method to color displays for personal computers or color cathode-ray tubes for highly minute televisions, in order to apply the method to these it was necessary to enhance the hole shape precision by using shaving processing, etc. The method according to the present invention has made it possible to apply to these matters.

Moreover, (embodiment 6) as explained in the method for assembling an electronic gun, according to conventional assembly methods, guide pins are passed through electron beam passage holes of electrode to assemble the electronic gun, whereby hitting flaw caused by pins during assembly, roughing of the inner surfaces of holes (broken-out surface), and characteristic failures due to bur possibly occurred. In contrast, according to the present invention, because electron beam passage holes are designed to have two steps, the assembly can be executed using the holes on the large-diameter side as guide holes, thereby being able to reduce characteristic failures occurring during the assembly.

What is claimed is:

1. A cathode-ray tube, comprising:

a plate having a first hole on a first surface of the plate and a second hole on a second surface of the plate, the first and second holes coupled together to allow electron beams to pass therethrough, the plate being a unitary structure, wherein the first hole is formed by initiating a first hole formation from the first surface and the second hole is formed by initiating a second hole formation from the second surface, the first surface being on an opposing side of the second surface.

2. The cathode-ray tube of claim 1, wherein the first hole has a first diameter and the second hole has a second diameter, wherein the first diameter is different from the second diameter, wherein the plate has a thickness t and the first diameter is greater than the second diameter by about 0.01 to 0.4t.

3. The cathode-ray tube of claim 2, wherein the first diameter is greater than the second diameter by about 0.01t to 0.2t, inclusive.

4. The cathode-ray tube of claim 2, wherein there are a plurality of first holes on the first surface of the plate and a plurality of second holes on the second surface of the plate, the plurality of the first holes have a first hole pitch, and the plurality of the second holes having a second hole pitch, a ratio of the first hole pitch to the second hole pitch is within a range of about 0.95–1.05, inclusive.

5. The cathode-ray tube of claim 2, wherein there are a plurality of first holes on the first surface of the plate and a plurality of second holes on the second surface of the plate, the plurality of the first holes have a first hole pitch, and the plurality of the second holes having a second hole pitch, a wherein if the first hole pitch is different from the second hole pitch, shapes of the holes on the surface from which electron beams exit are elliptical.

6. The cathode-ray tube of claim 5, wherein the elliptical hole on the exit surface has a large diameter and a small diameter, the ratio of the large diameter to the small diameter is within a range of about 1.002–1.08, inclusive.

7. The cathode-ray tube of claim 6, wherein the plate is a metal plate.

8. A method for producing a metal plate in which a hole is punched using a punch and a die, the metal plate having a first surface side, a second surface side and a thickness t therebetween, the method comprising:

punching a first hole through the metal plate from the first surface side of the metal plate until about middle of the thickness t is reached; and thereafter, punching a second hole through the metal plate from the second surface side to form the second hole that is coupled to the first hole, wherein the plate is a unitary structure and the first and second surface sides are opposing surfaces of the plate.

9. The method for producing a metal plate according to claim 8, wherein the punch having a first diameter and the die having a second diameter, the first diameter being about 1–40% greater than the second diameter, and wherein the punching step to form the first hole is stopped once about 55–65% of the thickness t has been reached.

10. The method for producing a metal plate according to claim 8, wherein the punch used for forming the first hole has an elliptic cross-sectional shape.

11. A method for producing a flat electrode of an electronic gun, having a plurality of holes, the method comprising:

punching to form a first hole through a metal plate from a first surface side of the metal plate until a given thickness of the metal plate is reached; and punching the metal plate to form a second hole coupled to the first hole from a second surface side of the metal plate, the first and second surface sides provided on opposing sides of the plate, wherein the given thickness is within a range of about 50% to about 90% of the thickness of the metal plate when measured from the first surface side.

12. The method of claim 11, wherein the given thickness is within a range of about 55% to about 65% of the thickness of the metal plate when measured from the first surface side.

13. A method for producing a flat electrode of an electronic gun, having a plurality of holes, the method comprising:

punching to form a first hole through a metal plate from a first surface side of the metal plate until a given thickness of the metal plate is reached; and punching the metal plate to form a second hole coupled to the first hole from a second surface side of the metal plate, wherein the given thickness is within a range of about 50% to about 90% of the thickness of the metal plate when measured from the first surface side.

14. The method of claim 13 wherein the given thickness is within a bout 55% to about 65% of the thickness of the metal plate when measured from the first surface side.

15. A method for producing a cathode-ray tube, the method comprising:

providing a cathode;

punching to form a first hole through a metal plate from a first surface side of the metal plate until a given thickness of the metal plate is reached; and punching the metal plate to form a second hole coupled to the first hole from a second surface side of the metal plate, the second surface provided on an opposing side of the first surface side, wherein the first hole is facing the cathode, the first hole being smaller than the second hole, wherein the given thickness is within a range of about 55% to about 65% of the thickness of the metal plate when measured from the first surface side.

* * * * *